US007207775B2

(12) United States Patent
Muriithi

(10) Patent No.: US 7,207,775 B2
(45) Date of Patent: Apr. 24, 2007

(54) TURBINE BUCKET WITH OPTIMIZED COOLING CIRCUIT

(75) Inventor: Kahwai Gachago Muriithi, Mauldin, SC (US)

(73) Assignee: General Electric Company, Schenectady, NY (US)

( * ) Notice: Subject to any disclaimer, the term of this patent is extended or adjusted under 35 U.S.C. 154(b) by 213 days.

(21) Appl. No.: 10/859,235

(22) Filed: Jun. 3, 2004

(65) Prior Publication Data

US 2005/0271507 A1 Dec. 8, 2005

(51) Int. Cl.
*F01D 5/18* (2006.01)

(52) U.S. Cl. ..... 416/92; 416/97 R

(58) Field of Classification Search ..... 416/92, 416/97 R, 248
See application file for complete search history.

(56) References Cited

U.S. PATENT DOCUMENTS

| | | | | |
|---|---|---|---|---|
| 3,738,771 | A | 6/1973 | Delarbre et al. | 416/96 |
| 3,791,758 | A * | 2/1974 | Jenkinson | 415/116 |
| 3,936,227 | A | 2/1976 | Wojcik | |
| 5,413,463 | A * | 5/1995 | Chiu et al. | 416/95 |
| 5,536,143 | A | 7/1996 | Jacala et al. | |
| 5,591,002 | A | 1/1997 | Cunha et al. | |
| 5,593,274 | A | 1/1997 | Carreno et al. | |
| 5,611,662 | A | 3/1997 | Cunha | |
| 5,634,766 | A | 6/1997 | Cunha et al. | |
| 5,743,708 | A | 4/1998 | Cunha et al. | |
| 6,390,774 | B1 | 5/2002 | Lewis et al. | |
| 6,397,604 | B1 | 6/2002 | Eldrid et al. | |
| 6,422,807 | B1 | 7/2002 | Leach et al. | |
| 6,422,817 | B1 | 7/2002 | Jacala | |
| 6,431,833 | B1 | 8/2002 | Jones | |
| 6,464,455 | B1 | 10/2002 | Wilson | |
| 6,464,461 | B1 | 10/2002 | Wilson et al. | |
| 6,477,773 | B1 | 11/2002 | Wilson et al. | |
| 6,491,498 | B1 * | 12/2002 | Seleski et al. | 416/191 |
| 6,506,022 | B1 * | 1/2003 | Bunker | 416/97 R |
| 6,554,566 | B1 | 4/2003 | Nigmatulin | |
| 6,644,921 | B1 * | 11/2003 | Bunker et al. | 416/97 R |
| 6,715,990 | B1 | 4/2004 | Arness et al. | |
| 6,722,852 | B1 | 4/2004 | Wedlake et al. | |
| 6,910,864 | B1 * | 6/2005 | Tomberg | 416/90 R |

FOREIGN PATENT DOCUMENTS

| | | |
|---|---|---|
| EP | 0 194 883 | 9/1986 |
| EP | 0 550 184 | 7/1993 |
| GB | 808837 | 2/1959 |
| GB | 855777 | 12/1960 |
| JP | 03-182602 | 8/1991 |

* cited by examiner

*Primary Examiner*—Edward K. Look
*Assistant Examiner*—Nathan Wiehe
(74) *Attorney, Agent, or Firm*—Nixon & Vanderhye P.C.

(57) ABSTRACT

A turbine bucket includes a cooling circuit through a dovetail section, a shank section and an airfoil section. The cooling circuit is configured to maximize cooling ability and maximize a useful life at base load operation at firing temperatures of up to 2084° F. while minimizing negative effects on performance. The cooling circuit includes a plurality of cooling holes having predetermined positions and sizes, resulting in increased cooling flow near a trailing edge of the airfoil section and effecting turbulation in the airfoil section to increase bulk and local creep margins throughout the airfoil section.

15 Claims, 8 Drawing Sheets

TURBINE BUCKET WITH OPTIMIZED COOLING CIRCUIT

BACKGROUND OF THE INVENTION

The present invention relates generally to turbine buckets and, more particularly, to a turbine bucket incorporating an optimized cooling circuit with modified cooling hole sizes and positions in an effort to maximize cooling ability and ensure a longer useful life.

In gas turbine engines and the like, a turbine operated by burning gases drives a compressor which furnishes air to a combustor. Such turbine engines operate at relatively high temperatures. The capacity of such an engine is limited to a large extent by the ability of the material from which the turbine blades (sometimes referred to herein as "buckets") are made to withstand thermal stresses which develop at such relatively high operating temperatures. The problem may be particularly severe in an industrial gas turbine engine because of the relatively large size of the turbine blades.

To enable higher operating temperatures and increased engine efficiency without risking blade failure, hollow, convectively-cooled turbine blades are frequently utilized. Such blades generally have interior passageways which provide flow passages to ensure efficient cooling, whereby all the portions of the blades may be maintained at relatively uniform temperatures.

While smooth-bore passages have been utilized, turbulence promoters, e.g., turbulators, are also used in many gas turbine buckets to enhance the internal heat transfer coefficient. The heat transfer enhancement can be as high as 2.5 times that of smooth-bore passages for the same cooling flow rate. Turbulators conventionally comprise internal ridges or roughened surfaces along the interior surfaces of the cooling passages and are typically cast inside the cooling passages using ceramic cores and/or STEM (shaped tube electrochemical machining) drilling.

In earlier attempts to improve the original four-hole stage 2 bucket, additional cooling was introduced by adding cooling holes and incorporating turbulators to increase the heat transfer coefficients at certain locations. The resulting seven-hole bucket was to be in uprated machines firing at 2075° F. Due to unbalanced stack issues, the seven-hole bucket design was severely local creep limited in its trailing edge.

A redesigned baseline six-hole bucket was better balanced and also incorporated turbulation; however, in an attempt to recover some performance, the cooling flow through the component was drastically reduced, leading to bulk creep life limitations.

BRIEF DESCRIPTION OF THE INVENTION

In an exemplary embodiment of the invention, a turbine bucket includes a cooling circuit through a dovetail section, a shank section, and an airfoil section. The cooling circuit is configured to maximize cooling ability and maximize useful life at base load operation at firing temperatures of up to 2084° F. while minimizing negative effects on performance.

In another exemplary embodiment of the invention, a turbine bucket includes a cooling circuit through a dovetail section, a shank section, and an airfoil section. The cooling circuit includes a plurality of cooling holes having predetermined positions and sizes, respectively, each extending through the dovetail section, the shank section and the airfoil section. The cooling holes extend through the dovetail section, the shank section and the airfoil section. A first through fifth of the cooling holes through the shank section have a diameter of about 0.140"+/−0.100", and a sixth cooling hole through the shank section comprises a diameter of about 0.100"+/−0.05".

DETAILED DESCRIPTION OF THE INVENTION

Figure 1:
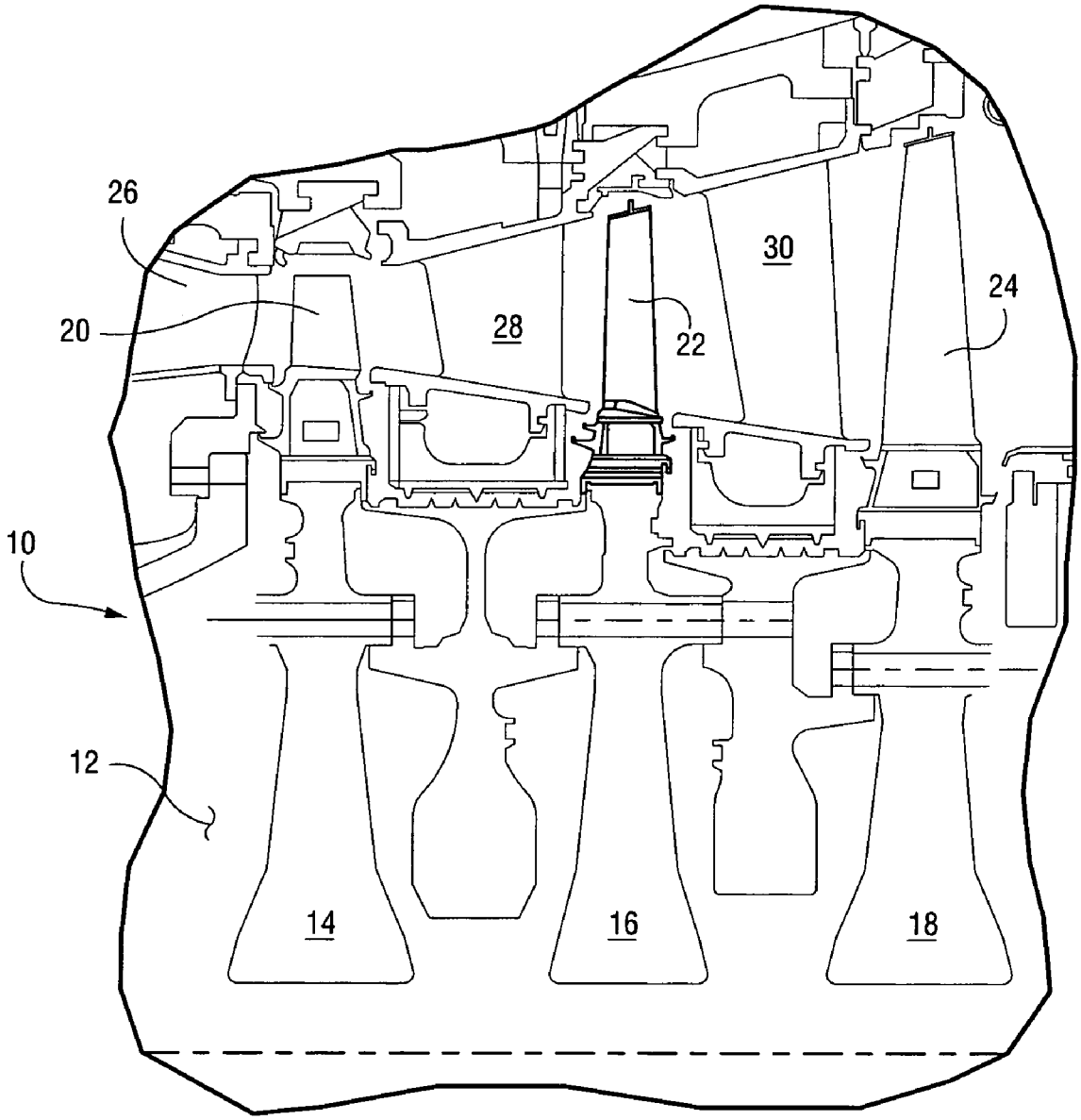
FIG. 1 is a schematic illustration of a turbine having a second stage turbine wheel employing turbine buckets.

With reference to FIG. 1, a portion of a turbine is generally designated at 10. The turbine 10 includes a rotor 12 having first, second and third stage rotor wheels 14, 16 and 18 having buckets 20, 22 and 24 in conjunction with the respective stator vanes 26, 28 and 30 of the various rotor stages. It will be appreciated that a three stage turbine is illustrated.

The second stage includes the rotor wheel 16 on which buckets 22 are mounted in axial opposition to the upstream stator vanes 28. It will be appreciated that a plurality of the buckets 22 are spaced circumferentially one from the other about the second stage wheel 16, and in this instance, there are 92 buckets mounted on the second stage wheel 16.

Figure 2:
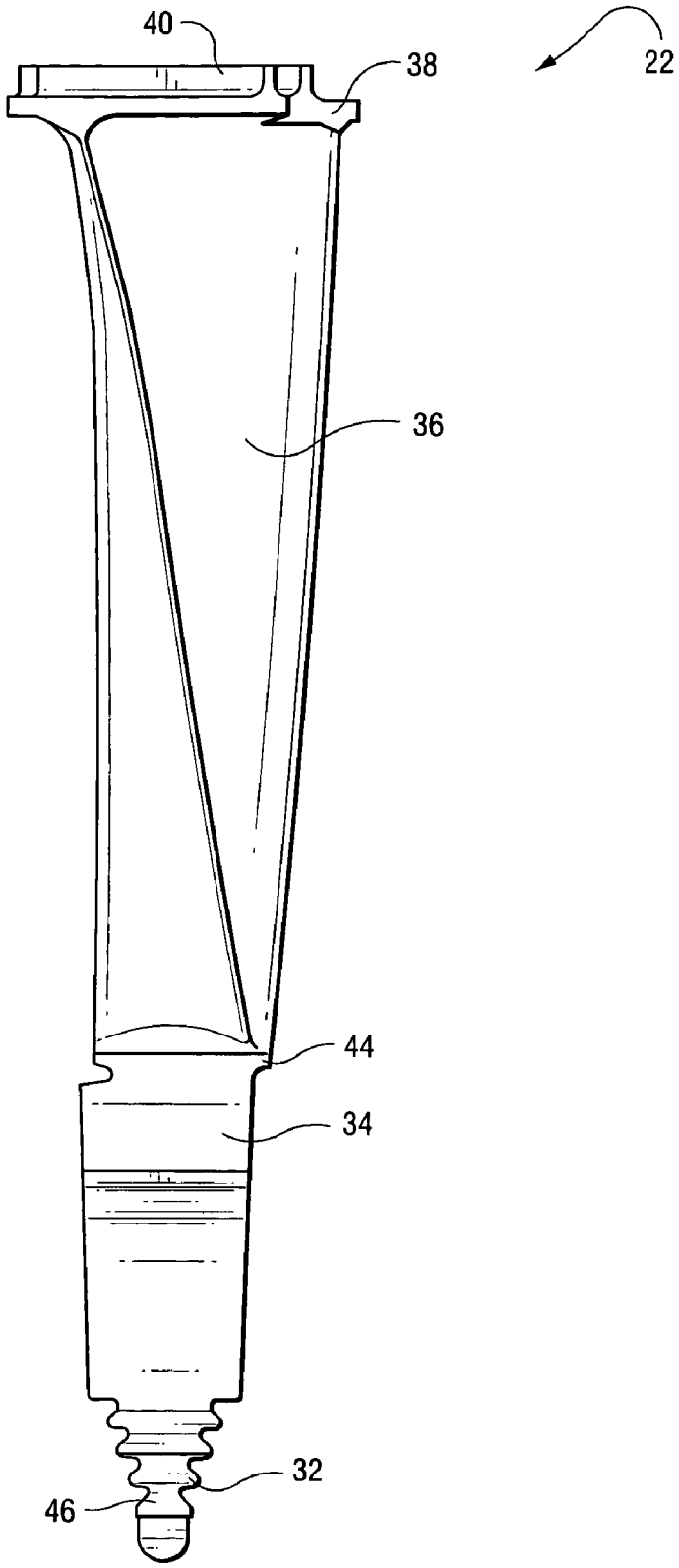
FIGS. 2 and 3 show side and front views, respectively of the turbine bucket.
Figure 3:
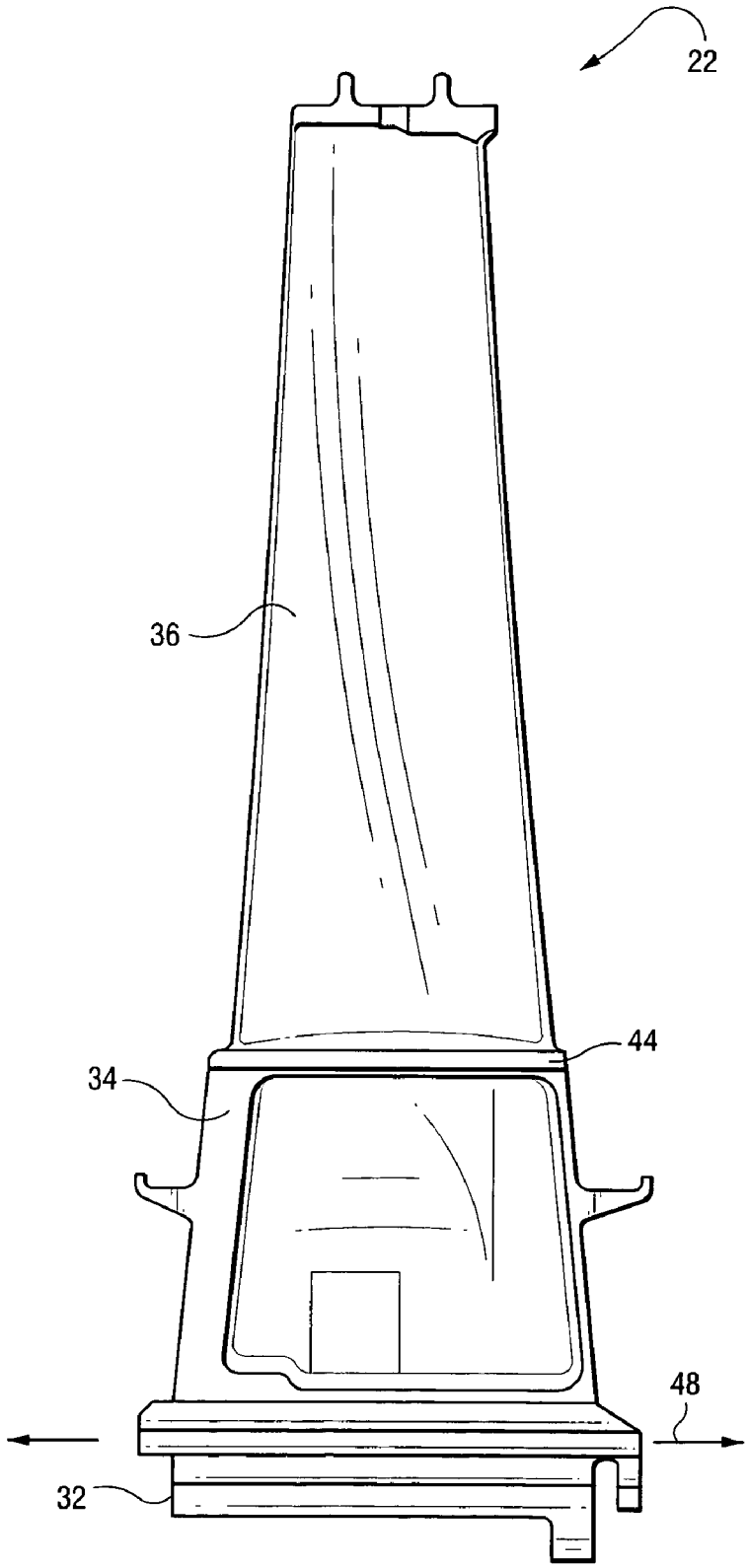
Figure 4:
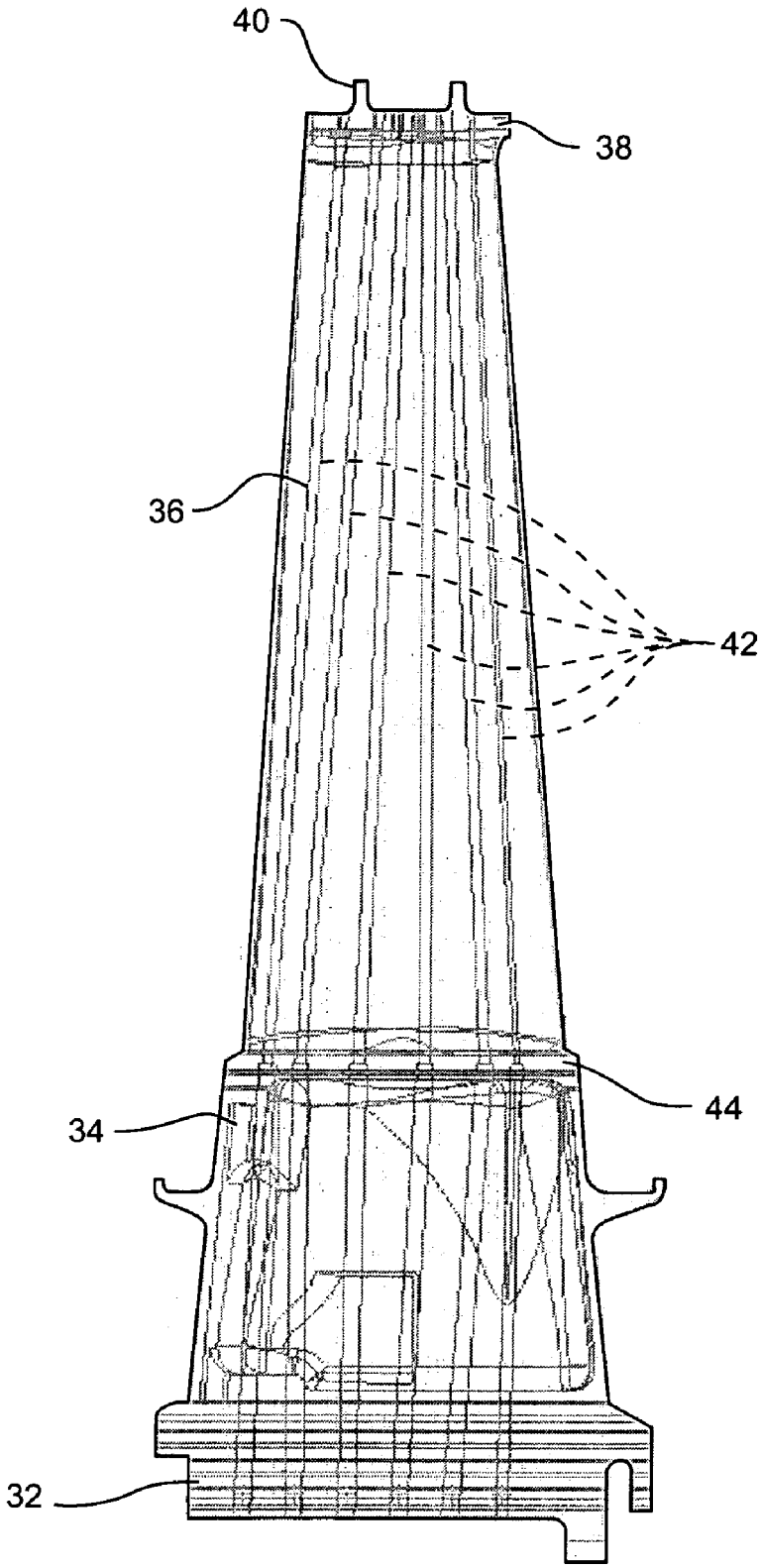
FIG. 4 is a front view of the turbine bucket showing the cooling passages.

With reference to FIGS. 2–4, the turbine bucket 22 includes a dovetail section 32, a shank section 34, and an airfoil section 36. A tip 38 of the airfoil section 36 includes seal rails 40.

In an effort to overcome bulk creep life limitations, it is desirable to increase the life of the stage 2 bucket to 96,000 factored hours in base load operation with minimal impact on overall engine performance. Cooling hole/passage locations have been adjusted in both the shank section 34 and the airfoil section 36 in order to allow hole diameter adjustments without violating minimum wall thickness requirements. Turbulation, which helps improve heat transfer capabilities, is also incorporated into the cooling holes in the airfoil section 36.

In past designs, turbulation started and ended at a similar span in all cooling holes in which it was applied. By use of current optimization tools and technology, it has been discovered that varying the start, end and span of turbulation can yield a better balanced life margin at all spans of the airfoil section 36.

Figure 5:
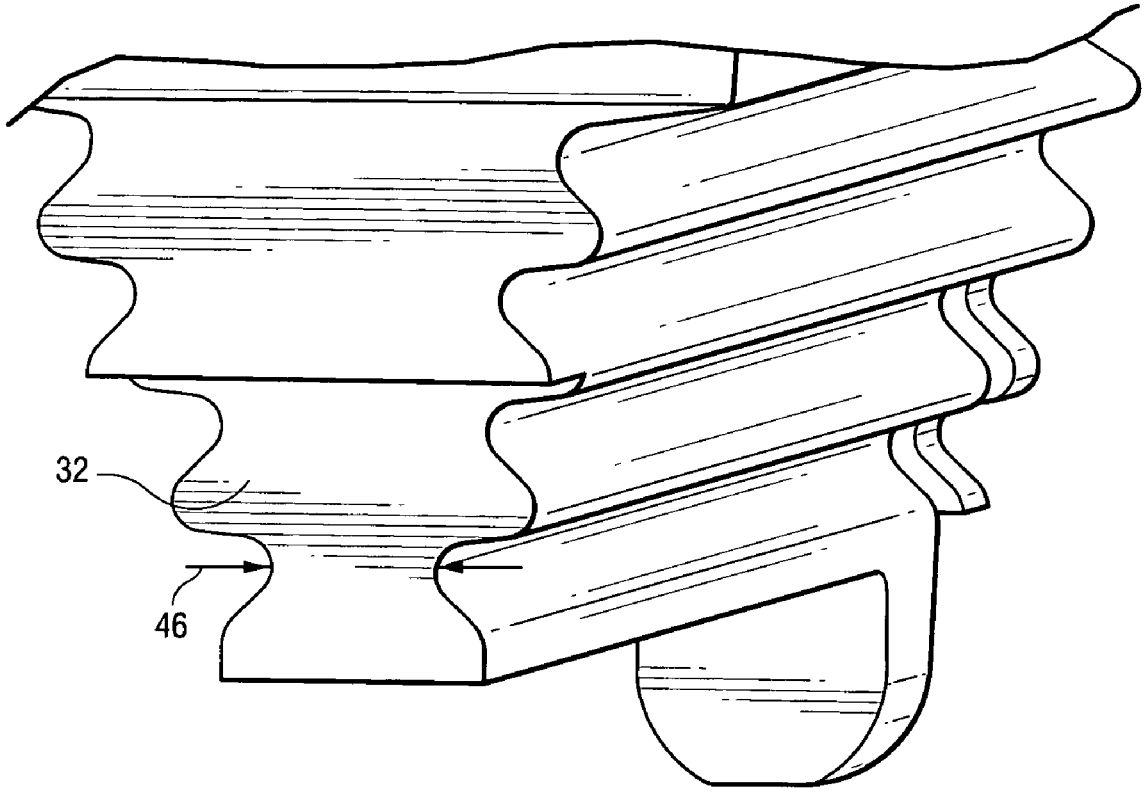
FIG. 5 is a perspective view of the dovetail section of the turbine bucket.

As shown, the cooling circuit includes six cooling holes/passages 42, including first, second, third, fourth, fifth and sixth cooling holes, each extending through the dovetail section 32, the shank section 34 and the airfoil section 36. With reference to FIGS. 4 and 5 and Table 1 below, in order to maximize available flow to the airfoil section 36, the cooling hole sizes in the shank section 34 are increased from the previous design to 0.140" for holes 1–5 (+/−0.100") and to 0.100" for the sixth hole (+/−0.05").

To ensure that minimum wall thickness requirements are not violated in the shank section 34 and the dovetail section 32, the cooling holes 42 in the shank section 34 are preferably centered on the minimum neck width of the dovetail section 32 as opposed to the bottom face of the shank. See 46 in FIGS. 2 and 5. The minimum acceptable wall thickness in the area of the cavity (at any neck of the dovetail) is 0.2× the smallest minimum neck width for racetrack cavities, and 0.12× for round cavities.

outlined in Table 1 was determined to best provide more uniform bulk creep margin along the entire airfoil for both diffusion and dry low NOx combustor applications, wherein holes 1–3 contain 20–85% airfoil span; holes 4 and 5 contain 40–85% airfoil span; and hole 6 is without turbulation. The turbulation spans noted encompass a tolerance of about +\−10%. The dimensions for determining start and end positions of turbulation components are measured from a plane 48 at a midpoint of the dovetail section 32.

TABLE 1

| Hole | Hole Diameter From 38 | Hole Diameter From 44 | 38 | | 44 | | 46 | | Start of Turbulation From | End of Turbulation | Number of |
|---|---|---|---|---|---|---|---|---|---|---|---|
| No. | to 44 | to 46 | X | Y | X | Y | X | Y | U-Plane | From U-Plane | Turbulators |
| 1 | 0.080 | 0.140 | −0.547 | 0.769 | −1.128 | −0.452 | −1.317 | 0.000 | 4.962 | 10.172 | 53 |
| 2 | 0.080 | 0.140 | −0.244 | 0.603 | −0.849 | −0.183 | −0.885 | 0.000 | 4.962 | 10.172 | 53 |
| 3 | 0.095 | 0.140 | −0.009 | 0.295 | −0.364 | 0.123 | −0.444 | 0.000 | 4.962 | 10.172 | 53 |
| 4 | 0.095 | 0.140 | 0.183 | −0.077 | 0.197 | 0.189 | 0.002 | 0.000 | 6.562 | 10.172 | 37 |
| 5 | 0.085 | 0.140 | 0.331 | −0.417 | 0.705 | −0.065 | 0.444 | 0.000 | 6.562 | 10.172 | 37 |
| 6 | 0.040 | 0.100 | 0.531 | −0.913 | 0.981 | −0.404 | 0.876 | 0.000 | — | — | — |

Figure 8:
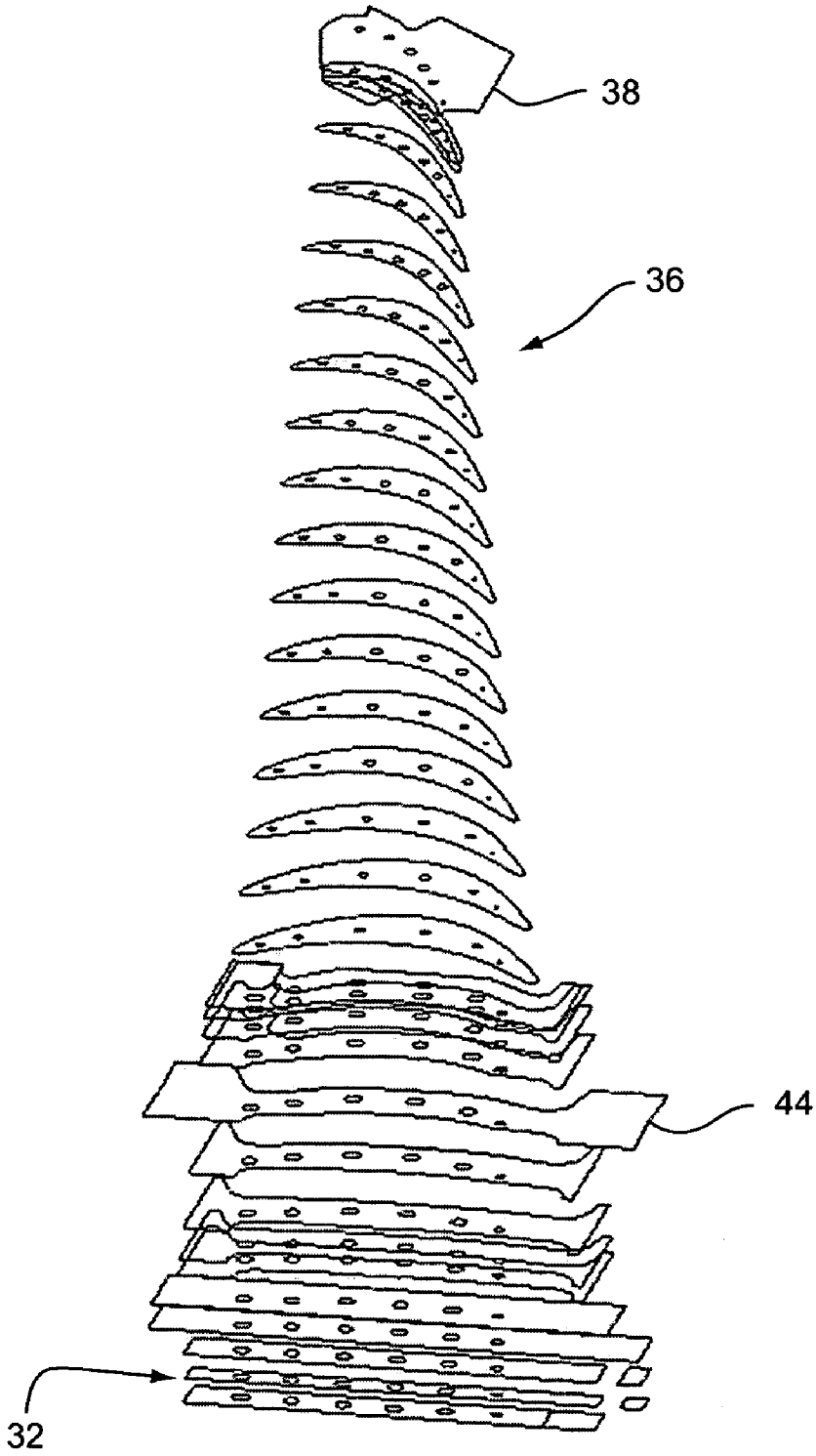
FIG. 8 is an exploded view of the turbine showing the positioning of cooling holes defining the cooling passages.

With continued reference to FIGS. 2–4, with the cooling holes 42 through the shank section 34 centered on the minimum neck width at the dovetail section 32, shank section hole and airfoil section hole intersection points are defined at a shank-airfoil intersection 44. See Table 1. Additionally, airfoil section 36 cooling hole exit locations are relocated to allow for diameter maximization without violation of minimum wall thickness requirements on one side while leaving excessive margin on the other. The exit locations are defined at the minimum neck width of the dovetail section 32, indicated at 46, the shank-airfoil intersection 44, and at the tip 38 of the airfoil section 36. See also, FIG. 8.

Table 1 provides exemplary cooling hole locations and hole diameters in a preferred arrangement of the turbine bucket 22. As demonstrated, in the airfoil section 36, from airfoil section cooling hole exit location 38 to the shank-airfoil intersection 44, the cooling hole diameter of holes 1 and 2 is 0.080", of holes 3 and 4 is 0.095", of hole 5 is 0.085", and of hole 6 is 0.040" with a dimensional tolerance of about +/−0.005".

Figure 6:
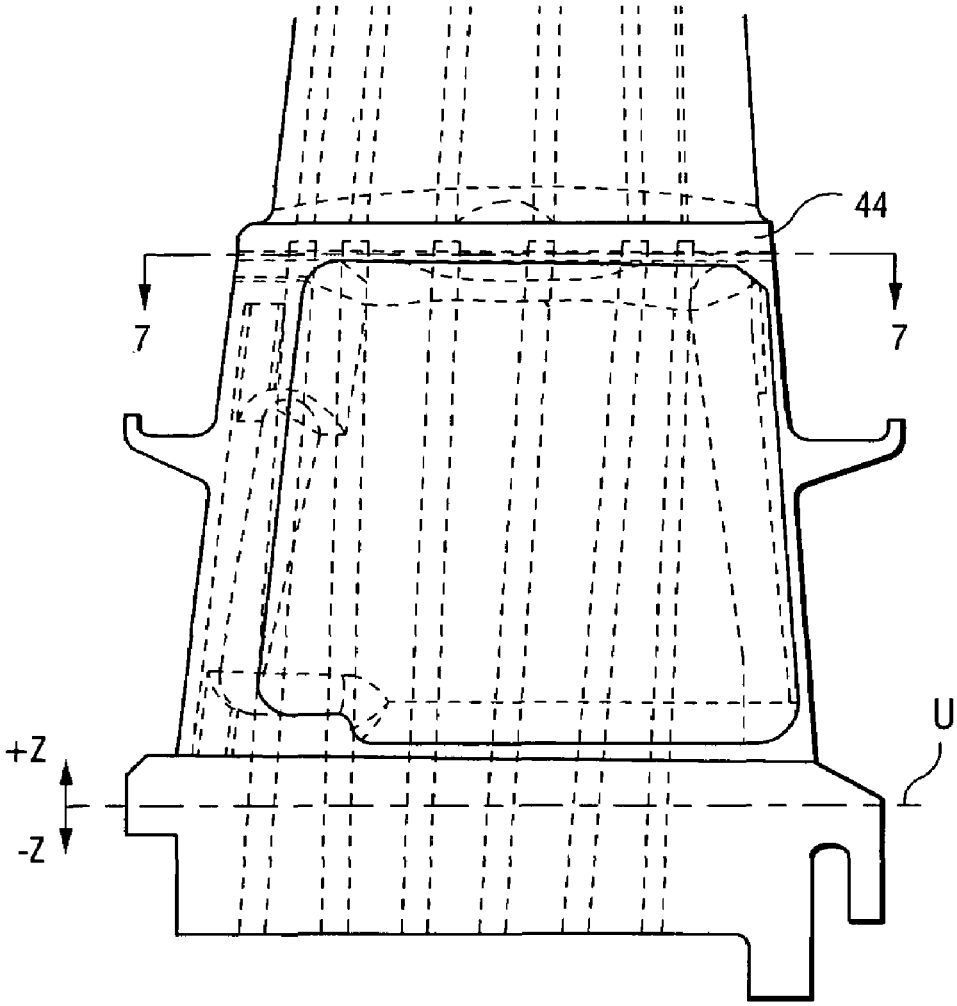
FIGS. 6 and 7 illustrate how cooling hole coordinates are established.
Figure 7:
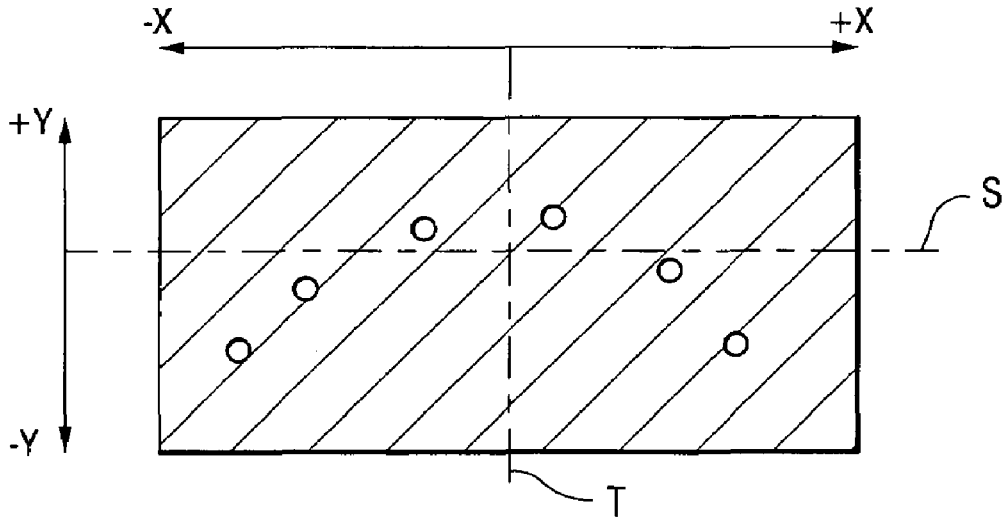

With reference to FIGS. 6 and 7, the origin of the X,Y,Z Cartesian coordinate system referenced in Table 1 used to locate the holes as well as the start and end of turbulation is the intersection of the S, T and U datum planes. These data planes are identified in the drawings. From FIG. 4, the U datum is through the shank center holes. FIG. 7 is a section cut through section 7—7 in FIG. 6, which represents the intersection of the shank and airfoil cooling holes. The distance X to the center of the holes is the distance from datum T, the distance Y is the distance from datum S, while the distance Z is the distance from datum U. Thus the origin of the coordinate system lies at the intersection of data S, T and U. During STEM drilling of the cooling holes, the bucket is held at these shank center holes. Once drilling is complete, the dovetail is machined and the shank center holes are also machined off.

Figure 9:
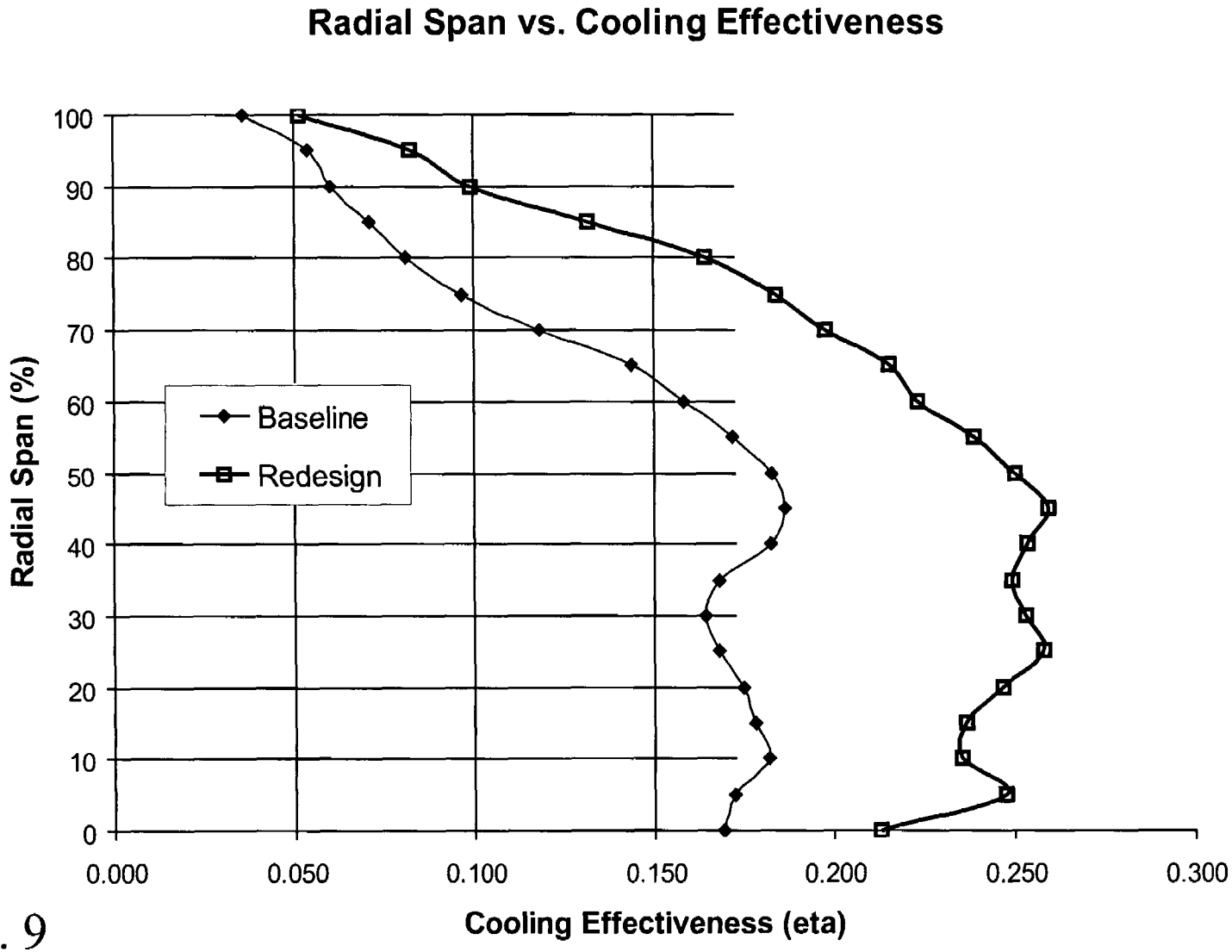
FIG. 9 is a graph showing improved cooling effectiveness of the turbine bucket.

Using an optimizer algorithm, such as Minitab available from Minitab, Inc. or Excel Solver from Microsoft, with continued reference to Table 1, the turbulation scheme Flow matching of flow models to prototype test stand data verified part life capability to design intent. FIG. 9 is a graph illustrating the cooling effectiveness of the turbine bucket including the cooling circuit of the invention (data line marked with squares) versus the cooling effectiveness of the prior baseline design (data line marked with diamonds) across the radial span of the airfoil section 36. As shown, it is clear that the new design provides better cooling throughout the entire airfoil section 36.

With this bucket having been redesigned to meet extended life capability in machines rated at firing temperatures of up to 2084° F., it can be applied to extend hot gas path inspection intervals and part lives for lower firing temperature machines, thereby reducing component replacement and outage costs.

The bucket cooling scheme described herein was optimized in order to maximize cooling ability to ensure a life of greater than 96,000 factored hours at base load operation at firing temperatures of up to 2084° F. while minimizing negative effects on performance by ensuring that only the optimal amount of air was used for cooling. By increasing cooling flow to regions where coolant was needed most, namely close to the trailing edge, and strategically turbulating the cooling holes, bulk and local creep margins were increased throughout the airfoil.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A turbine bucket comprising a cooling circuit through a dovetail section, a shank section, and an airfoil section, the cooling circuit being configured to maximize cooling ability and maximize a useful life at base load operation at firing temperatures of up to 2084° F. while minimizing negative effects on performance, wherein the cooling circuit is further configured to increase cooling flow near a trailing edge of the airfoil section and to effect turbulation in the airfoil section to increase bulk and local creep margins throughout the airfoil section, wherein the cooling circuit comprises six cooling holes having predetermined positions and sizes, respectively, including first, second, third, fourth, fifth and sixth cooling holes, each extending through the dovetail section, the shank section and the airfoil section, the six cooling holes through the shank section being centered on a minimum neck width of the dovetail section.

2. A turbine bucket according to claim 1, wherein the first through fifth cooling holes through the shank section comprise a diameter of about 0.140"+/−0.100", and the sixth cooling hole through the shank section comprises a diameter of about 0.100"+/−0.05".

3. A turbine bucket according to claim 1, wherein the first and second cooling holes through the airfoil section comprise a diameter of about 0.080"+/−0.05", the third and fourth cooling holes through the airfoil section comprises a diameter of about 0.095"+/−0.05", the fifth cooling hole through the airfoil section comprises a diameter of about 0.085"+/−0.05", and the sixth cooling hole through the airfoil section comprises a diameter of about 0.040".

4. A turbine bucket according to claim 1, wherein the first through fifth cooling holes through the shank section comprise a diameter of about 0.140", and the sixth cooling hole through the shank section comprises a diameter of about 0.100", and wherein the first and second cooling holes through the airfoil section comprise a diameter of about 0.080", the third and fourth cooling holes through the airfoil section comprise a diameter of about 0.095", the fifth cooling hole through the airfoil section comprises a diameter of about 0.085", and the sixth cooling hole through the airfoil section comprises a diameter of about 0.040".

5. A turbine bucket according to claim 1, wherein the cooling circuit comprises turbulation structure on interior surfaces of the cooling holes along the airfoil section, the percentage coverage of the turbulation structure varying from cooling hole to cooling hole.

6. A turbine bucket according to claim 5, wherein the percentage coverage comprises up to 85% of airfoil span for the first through fifth cooling holes.

7. A turbine bucket according to claim 1, wherein the cooling circuit is configured to ensure a life of greater than 96,000 factored hours.

8. A method of constructing a turbine bucket including a cooling circuit through a dovetail section, a shank section, and an airfoil section, the method comprising configuring the cooling circuit to maximize cooling ability and maximize a useful life at base load operation at firing temperatures of up to 2084° F. while minimizing negative effects on performance, wherein the configuring step further comprises configuring the cooling circuit to increase cooling flow near a trailing edge of the airfoil section and to effect turbulation in the airfoil section to increase bulk and local creep margins throughout the airfoil section, wherein the configuring step comprises forming a plurality of cooling holes having predetermined positions and sizes, respectively, and wherein the first through fifth cooling holes through the shank section comprise a diameter of about 0.140", and the sixth cooling hole through the shank section comprises a diameter of about 0.100", and wherein the first and second cooling holes through the airfoil section comprise a diameter of about 0.080", the third and fourth cooling holes through the airfoil section comprise a diameter of about 0.095", the fifth cooling hole through the airfoil section comprises a diameter of about 0.085", and the sixth cooling hole through the airfoil section comprises a diameter of about 0.040".

9. A turbine bucket comprising a cooling circuit through a dovetail section, a shank section, and an airfoil section, the cooling circuit including a plurality of cooling holes having predetermined positions and sizes, respectively, each extending through the dovetail section, the shank section and the airfoil section, wherein the cooling holes extend through the dovetail section, the shank section and the airfoil section, and wherein a first through fifth of the cooling holes through the shank section comprise a diameter of about 0.140"+/−0.100", and a sixth cooling hole through the shank section comprises a diameter of about 0.100"+/−0.05".

10. A turbine bucket according to claim 9, wherein the cooling holes through the shank section are centered on a minimum neck width of the dovetail section.

11. A turbine bucket according to claim 9, wherein the first and second cooling holes through the airfoil section comprise a diameter of about 0.080"+/−0.05", the third and fourth cooling holes through the airfoil section comprises a diameter of about 0.095"+/−0.05", the fifth cooling hole through the airfoil section comprises a diameter of about 0.085"+/−0.05", and the sixth cooling hole through the airfoil section comprises a diameter of about 0.040".

12. A turbine bucket according to claim 9, wherein the first through fifth cooling holes through the shank section comprise a diameter of about 0.140", and the sixth cooling hole through the shank section comprises a diameter of about 0.100", and wherein the first and second cooling holes through the airfoil section comprise a diameter of about 0.080", the third and fourth cooling holes through the airfoil section comprise a diameter of about 0.095", the fifth cooling hole through the airfoil section comprises a diameter of about 0.085", and the sixth cooling hole through the airfoil section comprises a diameter of about 0.040".

13. A turbine bucket according to claim 9, wherein the cooling circuit comprises turbulation structure on interior surfaces of the cooling holes along the airfoil section, the percentage coverage of the turbulation structure varying from cooling hole to cooling hole.

14. A turbine bucket according to claim 13, wherein the percentage coverage comprises about 20–85% +/−10% of airfoil span for the first through third cooling holes, and about 40–85% +/−10% of airfoil span for the fourth and fifth cooling holes.

15. A turbine bucket according to claim 13, wherein the percentage coverage comprises about 20–85% of airfoil span for the first through third cooling holes, and about 40–85% of airfoil span for the fourth and fifth cooling holes.

* * * * *